US006557783B1

(12) United States Patent
Foster et al.

(10) Patent No.: US 6,557,783 B1
(45) Date of Patent: May 6, 2003

(54) TELESCOPING FOAMER NOZZLE

(75) Inventors: Donald D. Foster, St. Charles, MO (US); Philipp Nelson, Wildwood, MO (US); Jeffrey Stark, O'Fallon, MO (US)

(73) Assignee: Continental Sprayers International, Inc., St. Peters, MO (US)

( * ) Notice: Subject to any disclaimer, the term of this patent is extended or adjusted under 35 U.S.C. 154(b) by 0 days.

(21) Appl. No.: 09/990,314

(22) Filed: Nov. 23, 2001

(51) Int. Cl.[7] ..... B05B 7/30

(52) U.S. Cl. ..... 239/343; 239/333; 239/505; 239/514; 239/391; 239/428.5; 239/539; 239/481

(58) Field of Search ..... 239/401, 403, 239/333, 343, 390, 391, 538, 539, 504, 505, 513, 514, 419.5, 428.5, 476–481; 222/380

(56) References Cited

U.S. PATENT DOCUMENTS

| | | | | |
|---|---|---|---|---|
| 1,900,087 A | | 3/1933 | Aronson | |
| 3,913,841 A | | 10/1975 | Tada | |
| 4,646,973 A | | 3/1987 | Focaracci | |
| 4,767,060 A | * | 8/1988 | Shay et al. | 239/428.5 |
| 4,890,792 A | * | 1/1990 | Martin et al. | 239/343 |
| 4,991,779 A | | 2/1991 | Blake, III | |
| 5,156,307 A | | 10/1992 | Callahan et al. | |
| 5,158,233 A | | 10/1992 | Foster et al. | |
| 5,340,031 A | | 8/1994 | Neuhaus et al. | |
| 5,344,079 A | | 9/1994 | Tasaki et al. | |
| 5,366,160 A | | 11/1994 | Balderrama | |
| 5,397,060 A | * | 3/1995 | Maas et al. | 239/504 |
| 5,540,389 A | | 7/1996 | Knickerbocker | |
| 5,647,539 A | | 7/1997 | Dobbs et al. | |
| 5,678,765 A | * | 10/1997 | Dobbs et al. | 239/343 |
| 6,227,411 B1 | * | 5/2001 | Good | 222/380 |

* cited by examiner

*Primary Examiner*—Steven J. Ganey
(74) *Attorney, Agent, or Firm*—Thompson Coburn LLP

(57) ABSTRACT

A nozzle assembly including a nozzle member, a cap member, a spinner and a foam tube. The cap member is rotationally mounted on the nozzle member and may be rotated from an "off-position" to a "foam-position" with continued rotation bringing the cap member to a "spray-position" and then to a second "foam-position" and then to the "off-position." Rotation of the cap member drives foam tube from a retracted position to an extended position extending forward of the nozzle member when the cap member is in the "foam-position." The spinner rotates to atomize liquid flowing through the assembly.

23 Claims, 11 Drawing Sheets

TELESCOPING FOAMER NOZZLE

FIELD OF THE INVENTION

The present invention relates generally to the field of sprayer equipment and more particularly, to a telescoping foamer nozzle.

BACKGROUND OF THE INVENTION

The prior art related to atomizers and sprayer equipment includes the following U.S. patents.

U.S. Pat. No. 1,900,087 to Aronson teaches an atomizer in which the operating elements are locked when the device is not in use, thereby preventing objectionable projection of the elements.

U.S. Pat. No. 3,913,841 to Tada shows a sprayer which suctions a liquid and squirts the liquid in an atomized form by applying a pressure to the liquid. The sprayer includes a piston which defines a liquid chamber in combination with a cylinder portion. When the piston is moved into proximity to the closed end of the cylinder, the volume of the liquid chamber formed by the cylinder is minimized, thereby resulting in high pressure squirting of liquid within the chamber.

U.S. Pat. No. 4,646,973 to Focaracci shows a sprayer for producing a foam from a spray of liquid and air. An interrupter is located in the path of a controlled portion of the outer periphery of a continuous stream of liquid. By controlling the amount of peripheral flow impinged upon by the interrupter in the stream periphery, turbulence is created with consequent pressure drop and ingress of counterflowing ambient air which mixed with and causes foaming of the liquid constituent of the flow.

U.S. Pat. No. 4,991,779 to Blake shows a device for producing foam which incorporates a porous element.

U.S. Pat. No. 5,156,307 to Calillahan et al. shows a dispenser which has a circular mixing chamber immediately in front of a mixing nozzle. A first channel leads into the mixing chamber from material located in a squeezable container. A second channel leads into the mixing chamber from an air space. A sieve covers the outlet channel.

U.S. Pat. No. 5,158,233 to Foster et al. shows a nozzle assembly with a foam-inducing tube in front of its nozzle outlet orifice. A door is provided with an elongated pin having a convex tip for sealing the outlet orifice.

U.S. Pat. No. 5,340,031 to Neuhaus et al. shows a foaming head and includes a discharge nozzle which has a deflecting plate having passage slits which open out radially to an outlet slit.

U.S. Pat. No. 5,344,070 to Tasaki et al. shows a foaming nozzle which is shaped so that the foam is ejected in the form of a band which may be elliptical, rectangular or triangular in shape. The foam is formed by the impingement of mist upon an inner face of the mouth of the foaming nozzle.

U.S. Pat. No. 5,366,160 to Balderama shows a foamer nozzle which incorporates opposing pairs of spaced apart looped ribs which are in a plane downstream from the discharge orifice. The ribs are teardrop shaped in cross-section and have a pair of spaced legs which define an opening.

U.S. Pat. No. 5,540,389 to Knickerbocker shows an orifice device which incorporates a spin chamber communicating with the terminal orifice. A plurality of feed channels communicate with the spin chamber for the purpose of spinning the spray product within the spin chamber prior to discharge.

U.S. Pat. No. 5,647,539 to Dobbs et al. shows an assembly which incorporates a foam enhancer chamber having a plurality of ribs which define uniform openings. The ribs have flat surfaces which are perpendicular to the inner wall of the chamber for the purpose of generating foam as foam bubbles impact against the ribs to mix with air.

Despite the various developments in the prior art, there remains a need for a nozzle which can easily and reversibly switch from operation in a foam dispensing mode to operation in a spray dispensing mode.

OBJECTS AND SUMMARY OF THE INVENTION

It is an object of the present invention to provide a telescoping foamer nozzle which can be easily and reversibly switched from a foam dispensing mode of operation to a spray dispensing mode of operation.

Another object of the present invention is to provide a telescoping foamer nozzle in which a foamer tube projects forward of a dispensing orifice when in the foam dispensing mode of operation.

Another object of the present invention is to provide a telescoping foamer nozzle which has a relatively small number of component parts resulting in reliable long-term operation.

Yet another object of the present invention is to provide a telescoping nozzle which has a relatively small number of component parts which can be manufactured easily in volume resulting in a relatively low unit cost.

These and other objects and advantages of the present invention will appear more clearly hereinafter.

In accordance with the present invention, there is provided a telescoping foamer nozzle which; include a nozzle member which has a feed tube connected to a supply of spray material. A cap member is rotationally mounted on the nozzle member. The cap member may be rotated relative to the nozzle member from an off-position to a foam-position with continued rotation bringing the cap member to a spray-position and then a second foam-position and then to the off-position. The cap member supports a foam tube which includes a cam boss which engages a cam groove formed in the nozzle member.

Rotation of the cap member drives the foam tube. The cam groove and cam boss drive the foam tube from a retracted position in which the cap member is in the off-position and in the spray-position to an extended position projecting forward of the discharge nozzle when the cap is in the foam position. The cap includes indicia which clearly mark the off-position, foam-position and spray position and the cap is proportioned to fit flush against the nozzle in each of the operating positions.

DESCRIPTION OF THE DRAWINGS

Other important objects and advantages of the invention will be apparent from the following detailed description of the invention taken in connection with the accompanying drawings in which.

DETAILED DESCRIPTION OF THE INVENTION

Figure 1:
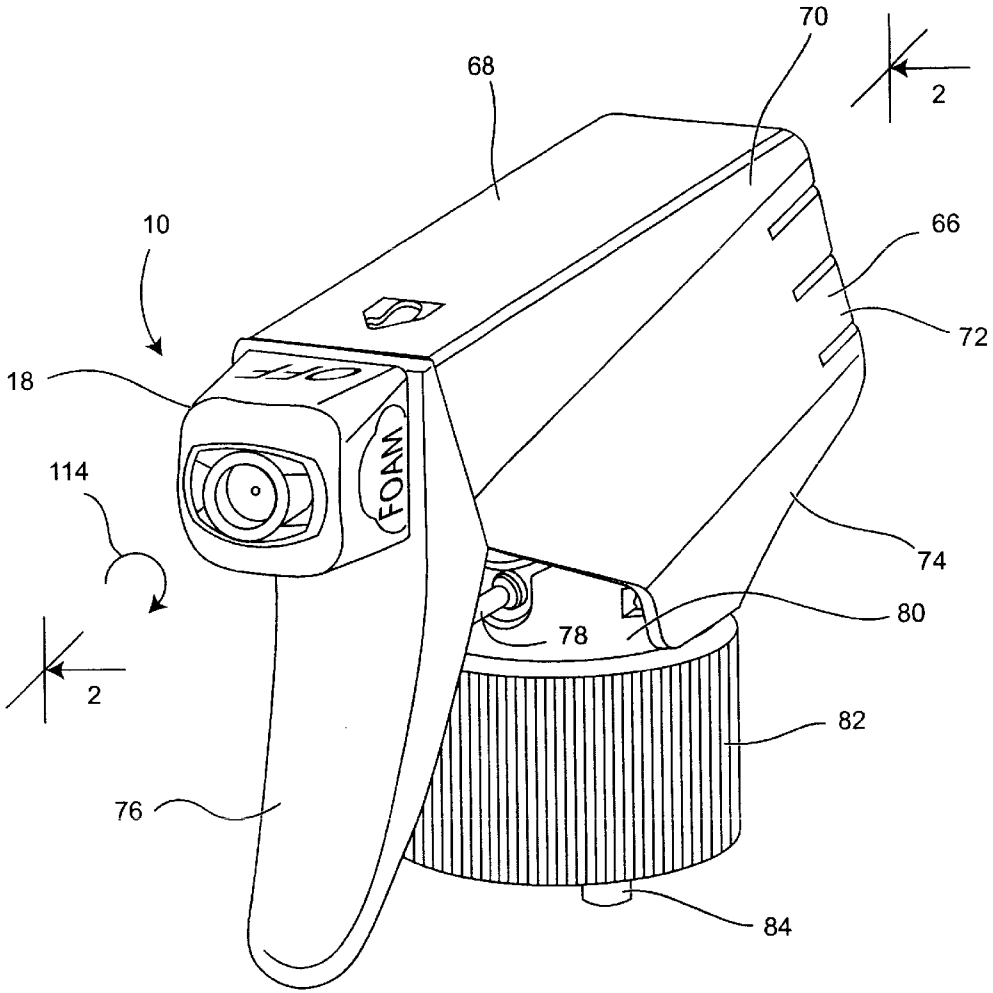
FIG. 1 is an overall perspective view of a telescoping foamer nozzle made in accordance with the present invention, with the telescoping foamer nozzle shown mounted on a spray canister.
Figure 2:
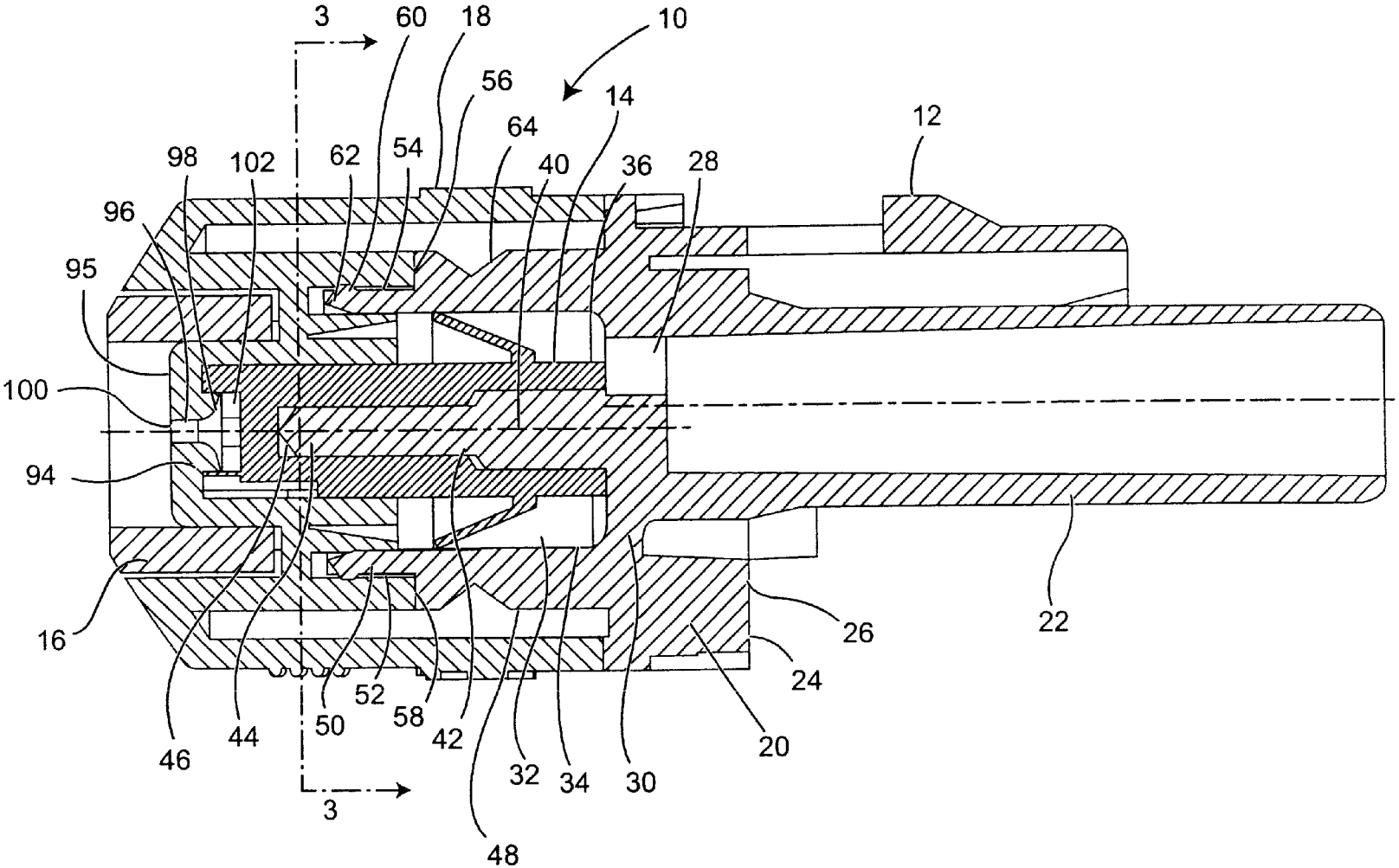
FIG. 2 is a cross-sectional view taken along the line 2—2 of FIG. 1 showing the components in the off-position.

With reference to the drawings, in which like reference numbers designate like or corresponding parts throughout, there is shown in FIGS. 1 and 2 a telescoping foamer nozzle generally designated by reference number 10, made in accordance with the present invention, which includes a nozzle member 12, a spinner member 14, a foamer tube 16, and a cap member 18.

As shown in FIG. 2, the nozzle member 12 is an integrally formed component which includes a central portion 20 and a centrally disposed feed tube 22 which projects from the rear surface 24 of the central portion. The feed tube 22 communicates via a port 28 formed in the central portion 30 with a cavity 32 which is defined by walls 34, 36 which project from the central portion 30.

A shaft 40 projects from the central portion 30. The shaft 40 is centrally located with respect to the walls 34, 36. The shaft 40 has a step portion 42, a generally square cross-section, and the end 44 of the shaft 40 is formed as a conical point 46.

Figure 6:
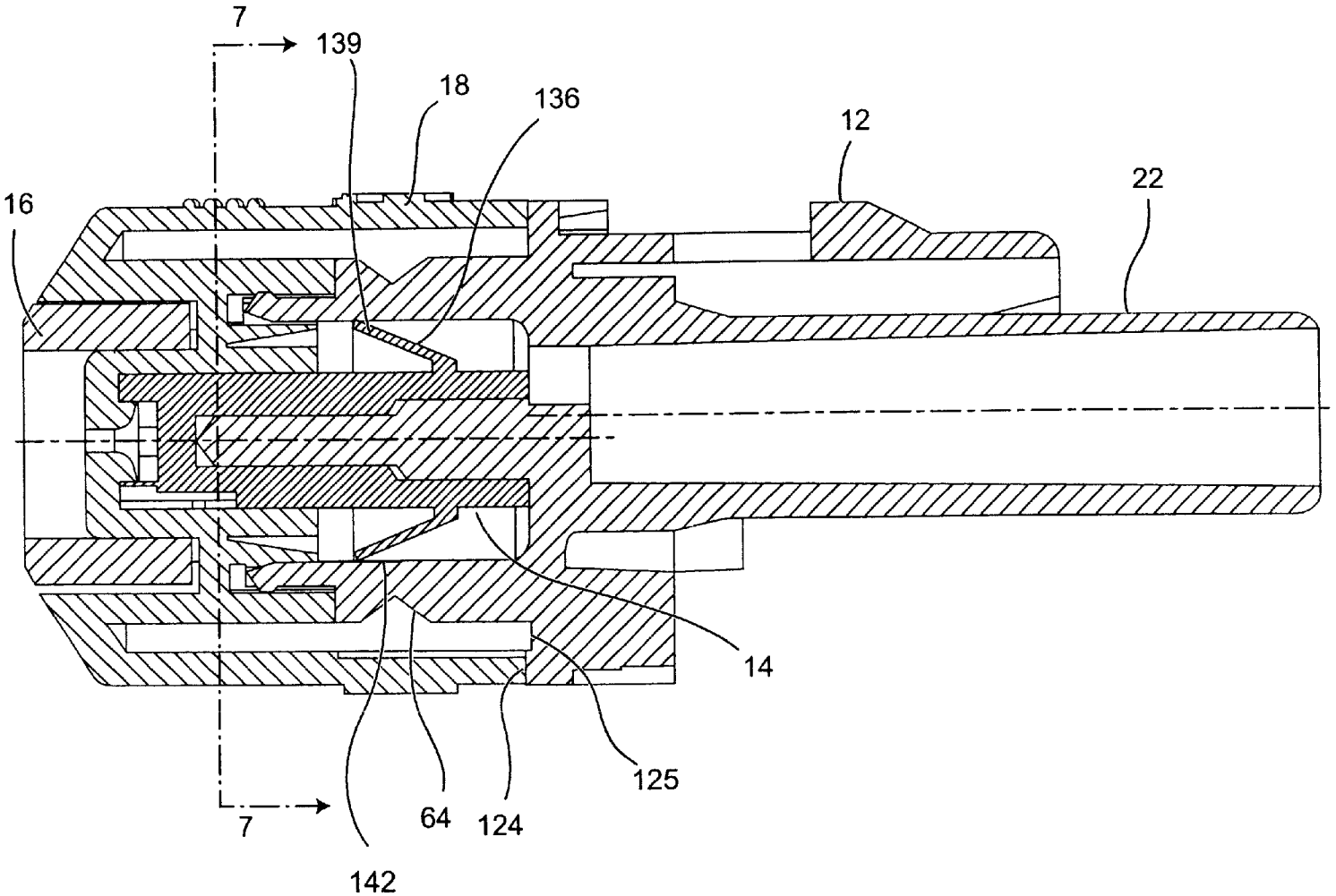
FIG. 6 is a cross-sectional view taken along the line 2—2 of FIG. 1 similar to FIG. 3 but showing the components in the spray-position.

The outside surface 48 of the walls 34, 36 have a step portion 50 which is defined by the wall portions 52, 54, 56. 58. The wall portions 52, 54 have an integrally formed collar 60 which retains the cap member 18 in a manner which will be presently described. The front portion 62 of the walls 52, 54 is tapered to facilitate ease of assembly of the cap member 18. The outer surface 48 of the walls 52, 54 includes a cam groove 64 which forms a key feature of the present invention. The cam groove 64 is shown in cross-section in FIGS. 2, 4 and 6 and in perspective in FIG. 9.

FIG. 1 shows the nozzle member 12 encased in a housing 66 which includes a top panel 68 and side panels 70, 72, 74. The telescoping foamer nozzle 10 is operated by a trigger 76 which is connected via plunger 78 to a valve 80 which is contained with the reservoir 82. The trigger 76 and the plunger 78 are conventional in nature and, therefore, have not been illustrated or described in detail. During use, the feed tube 22 receives a supply of spray material in liquid form via the conduit 84.

The cap 18 is a hollow member which includes side wall portions 86, 88, 90, 92 and a front wall portion 95. The cap member 18 includes an inwardly projecting generally cylindrical portion 94 which has a central nozzle 96. The nozzle 96 includes a converging portion 98 which communicates with an exit port 100. The converging portion 98 also communicates with a central bore 102. The central bore 102 accommodates the shaft 104 of spinner member 14.

The projecting portion 90 includes a v-shaped groove 106 and a rectangular groove 108. The v-shaped groove 108 results in a degree of flexibility in the portion 110 adjacent to the rectangular groove. The rectangular groove 108 includes an undercut 112 which accepts the collar 60 formed on the nozzle member 12. The v-shaped groove 106 allows the cap member 18 to snap onto the collar 60 and allows the cap member 18 to rotate relative to the nozzle member 12 as is shown by the arrow 114 in FIG. 1. The side wall portions 86, 88, 90, 92 of the cap 18 are proportioned to closely match the surfaces 116, 118, 120, 122 of the nozzle member 12 and the end 124 of the cap 18 abuts the surface 125 of the nozzle member 12.

The spinner member 14 includes a central portion 126 which has a square bore 128 fits on the square shaft 40. The square shaft 40 and the square bore 128 prevent rotation of the spinner member 14 relative to the shaft 40. The end 129 of the bore 128 abuts the conical point 46 on the shaft 40. The spinner member 14 includes an integrally formed tapered flange portion 136.

The flange portion 136 has the overall configuration of a hollow cone. The outer edge 139 of the flange portion 136is proportioned to form an interference fit with the bore 142.

The flange 136 portion is relatively thin and is molded in a relatively flexible plastic material. This construction results in a degree of flexibility of the flange portion 136 in the radial direction shown for reference by the arrow 144 in FIG. 10. This flexibility enables spray material to flow past the flange portion 136 as is shown by the arrows 146, 147, 148 in FIGS. 10 and 11 and prevent the flow of air in the opposite direction shown by the arrow 149 in FIG. 10.

The flexible flange portion 136 and the bore 142 thus form a bias-closed valve. During use, the spray material flows past the flange portion 136.

Figure 3:
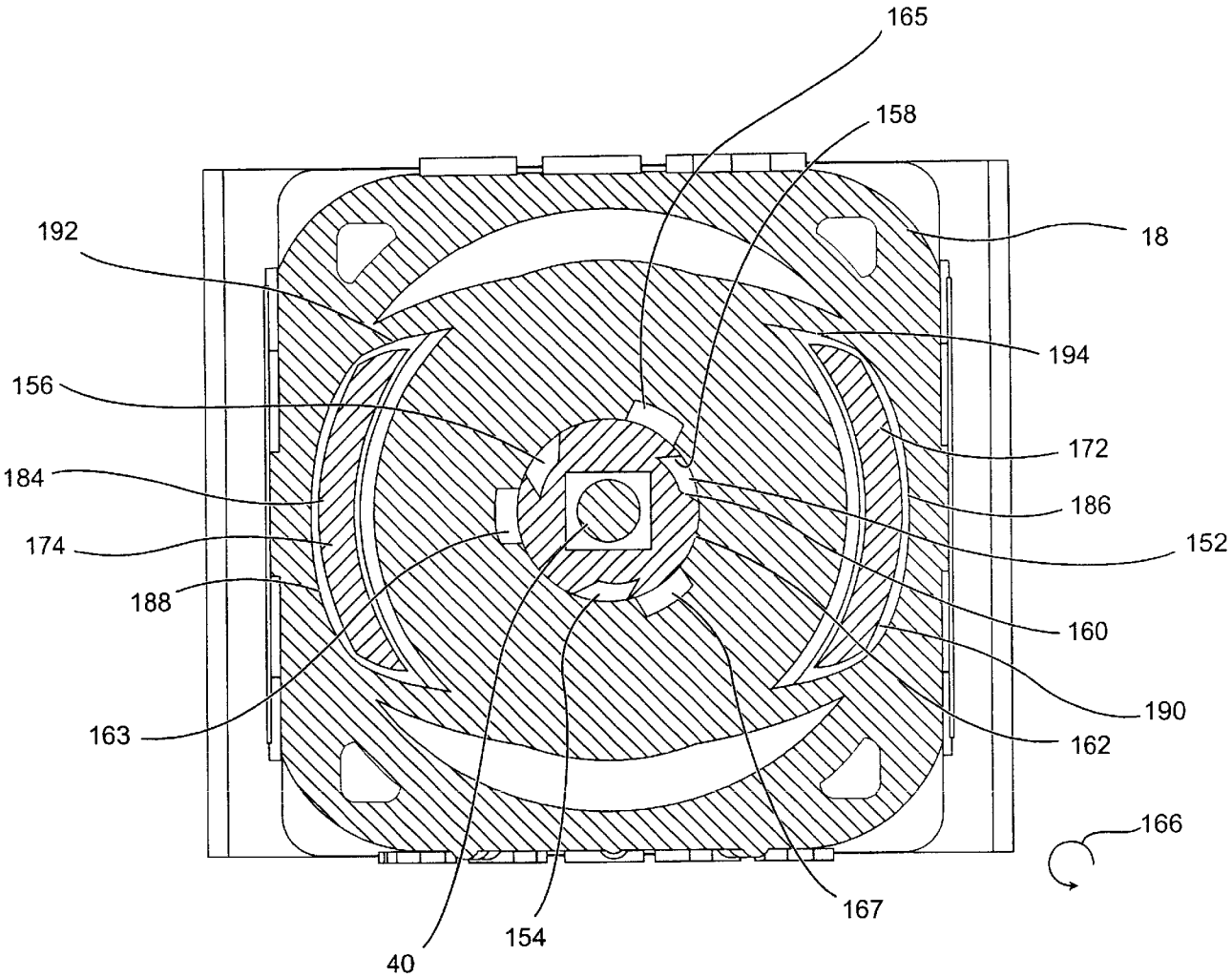
FIG. 3 is a cross-sectional view taken along the line 3—3 of FIG. 2.
Figure 9:
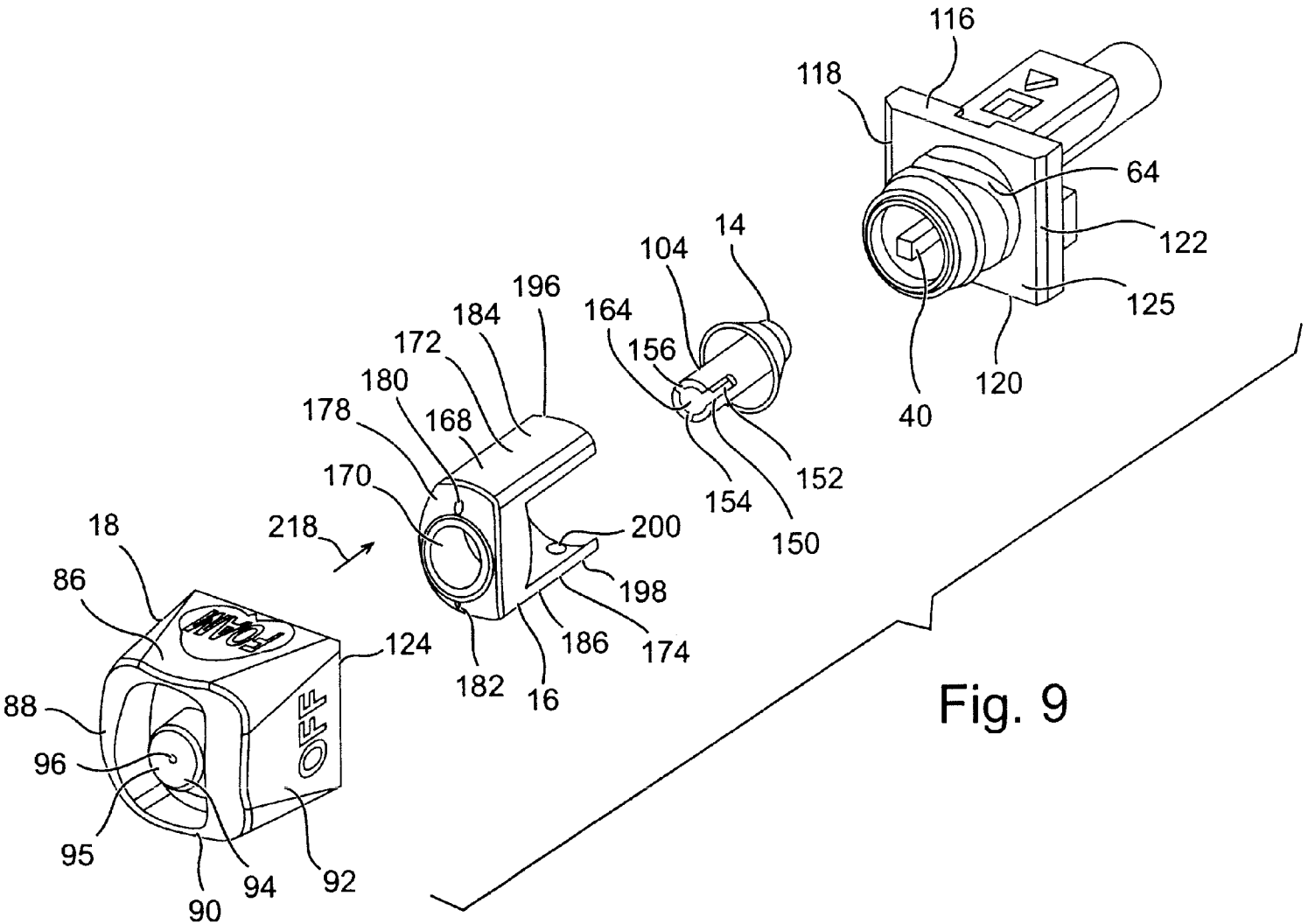
FIG. 9 is an exploded perspective view showing the various components.

As is shown in FIG. 9, the face portion 150 of the spinner member 14 includes three apertures 152, 154, 156. Each aperture is defined by a pair of side walls 158, 160 as shown in FIG. 3. The side wall 158 forms an acute angle with the surface 162 and the side wall 160 forms an obtuse angle with the surface 162. During use, the spray material flows through the channels 163, 165, 167 and enters the spinner cavity 164. The angular orientation of the sidewalls 158, 160 causes the spray material to enter the spinner cavity 164, which is relatively small, in a generally tangential direction with reference to the surface 162 thereby causing the rotation of the spray material and thereby resulting in atomization of the flow of the spray material.

The foamer tube 16 includes a central portion 168 which includes a central bore 170 and a pair of guide legs 172, 174 as is best shown in FIG. 9. The central bore 170 accepts the end portion 176 of the nozzle member 12. The outer surface 178 of the foamer tube 16 optionally has a pair of air openings 180, 182 which extend through the central portion 168 to provide extra air if needed. The outer surfaces 184, 186 of the guides legs 172, 174 are generally curved and are proportioned to slid within complementary curved portions 188, 190 of the cap member 18.

The guide legs 172, 174 project through apertures 192, 194 which are formed in the cap member 18 so that rotation of the cap member 18 causes rotation of the foamer tube 16.

Figure 10:
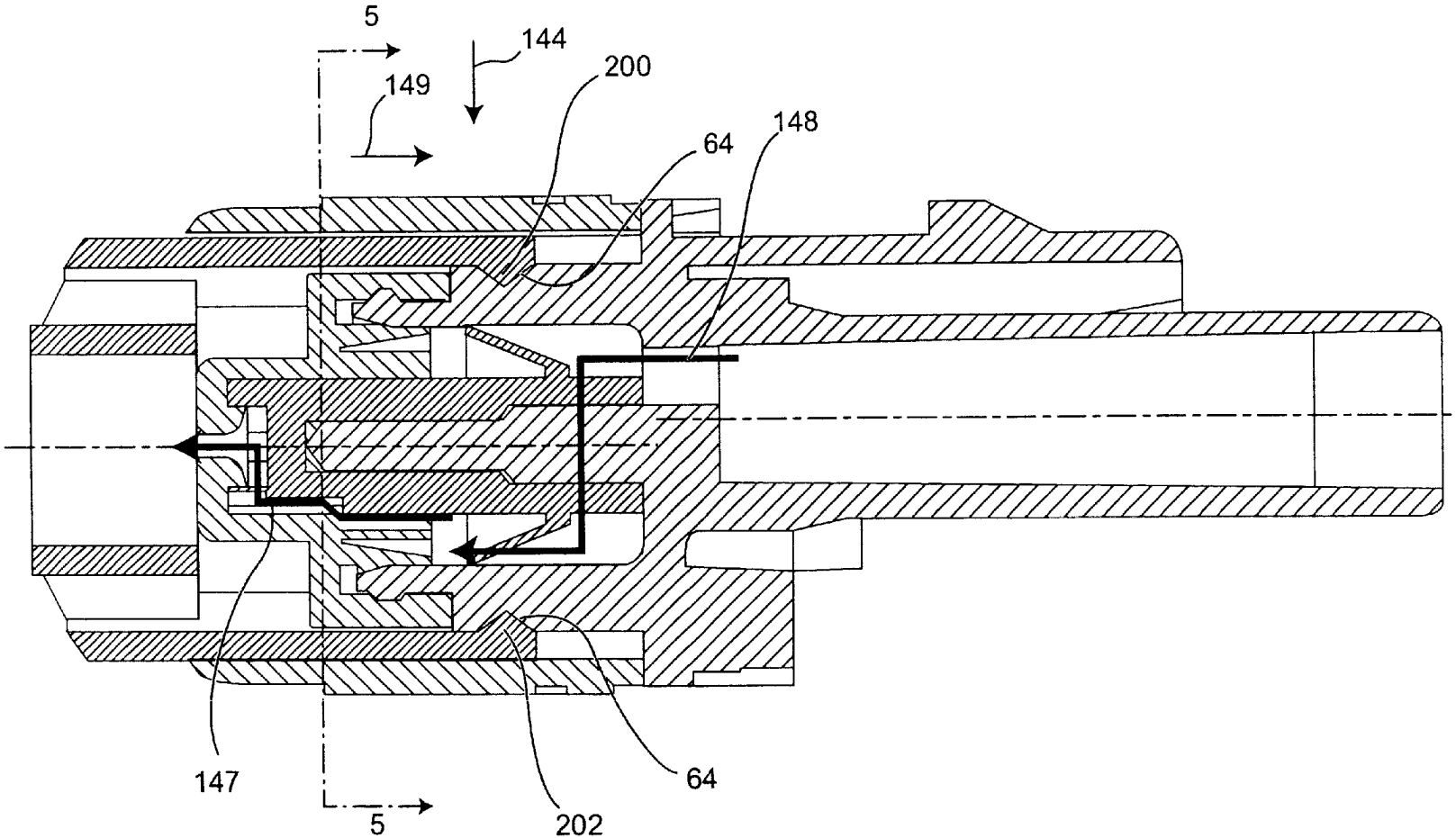
FIG. 10 is a cross-section view similar to FIG. 4 showing the components in the foam position and showing the flow of spray material.
Figure 11:
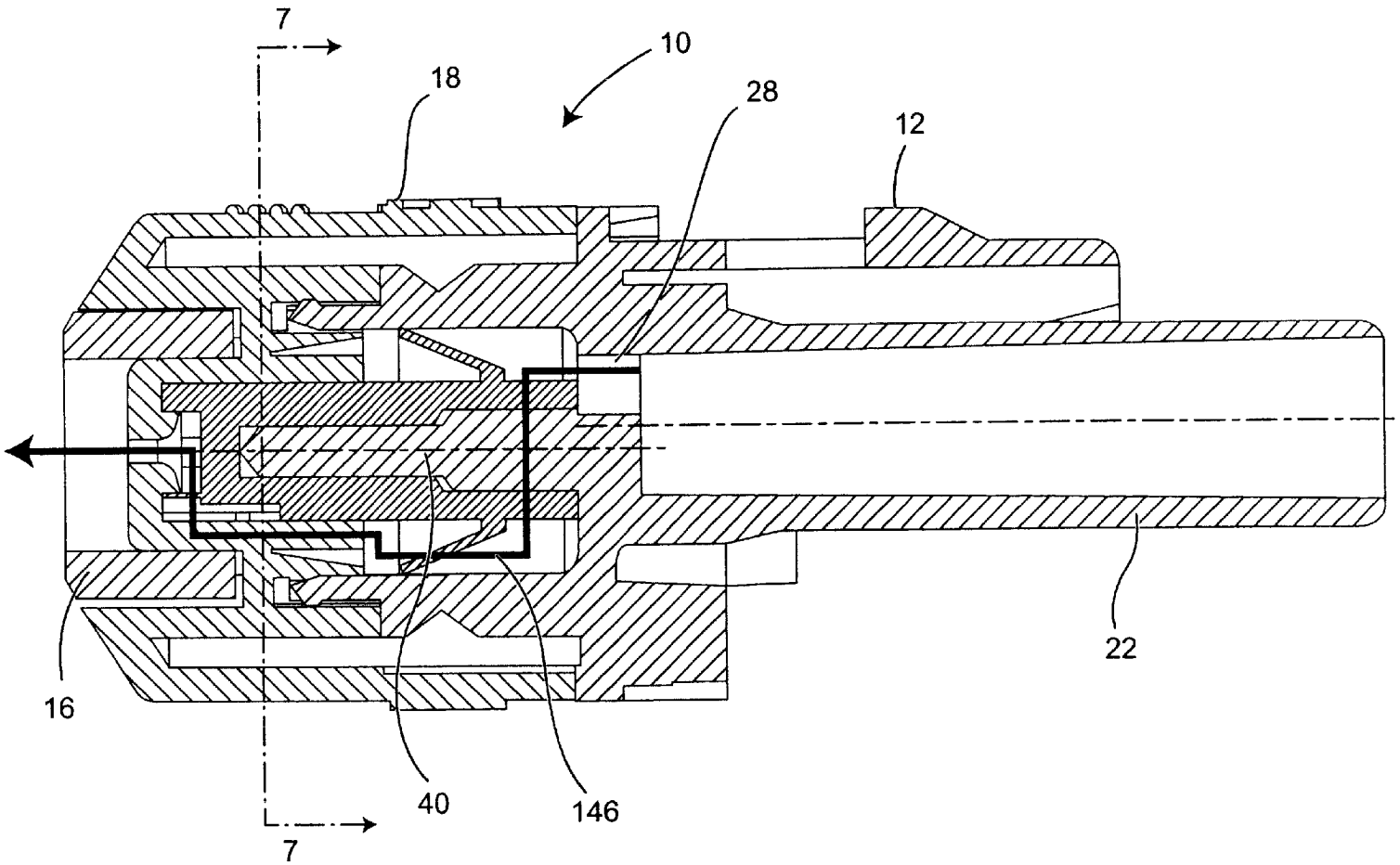
FIG. 11 is a cross-sectional view similar to FIG. 6 showing the components in the spray position, and showing the flow of spray material.

The end portions 196, 198 of the guide legs 172, 174 each have a cam follower boss 200, 202 which engage the cam groove 64 in the nozzle member 12 as is shown in FIG. 10.

The sidewall portions 86, 88, 90, 92 of the cap have the following integrally molded indicia formed thereon, respectively, "off," "foam," "spray" and "foam" 204, 206, 208, 210. Rotation of the cap 18 in the direction 212 shown by the arrow in FIG. 1 from the "off-position" shown in FIGS. 2 and 3 to the "foam-position" shown in FIG. 4 and 5 rotates the foamer tube 16 and the cam groove 64 drives the foamer tube 16 to the extended position shown in FIG. 4.

Figure 4:
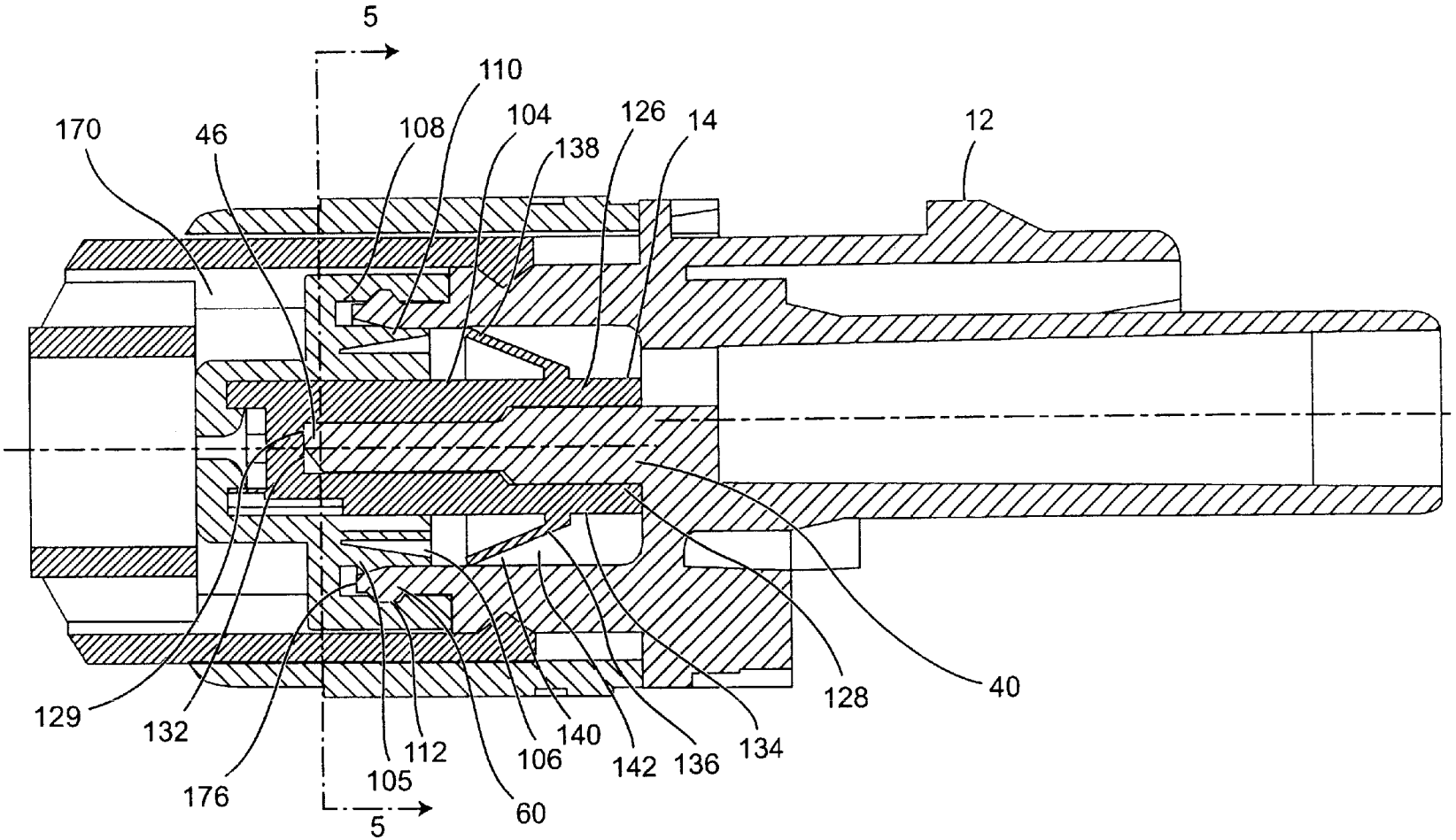
FIG. 4 is a cross-sectional view taken along the line 2—2 of FIG. 1 similar to FIG. 3 but showing the components in the foam-position.
Figure 5:
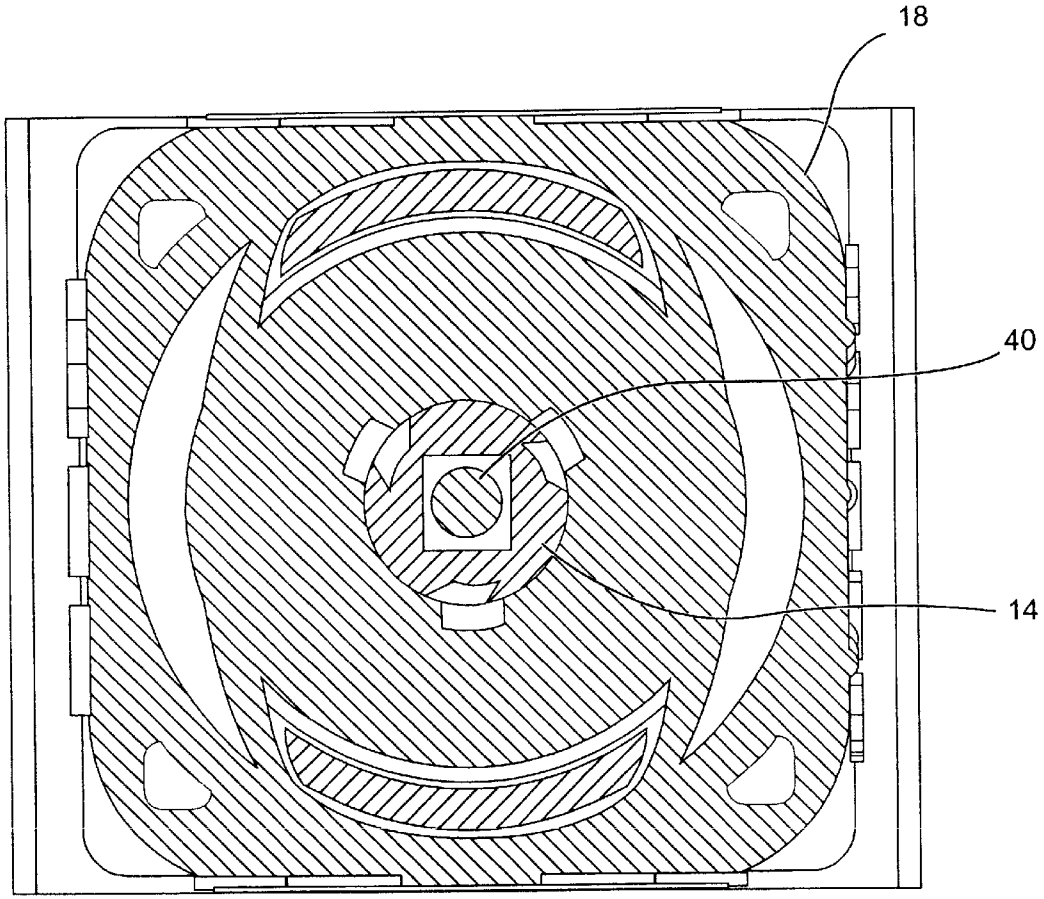
FIG. 5 is a cross-sectional view taken along the line 5—5 of FIG. 4.
Figure 7:
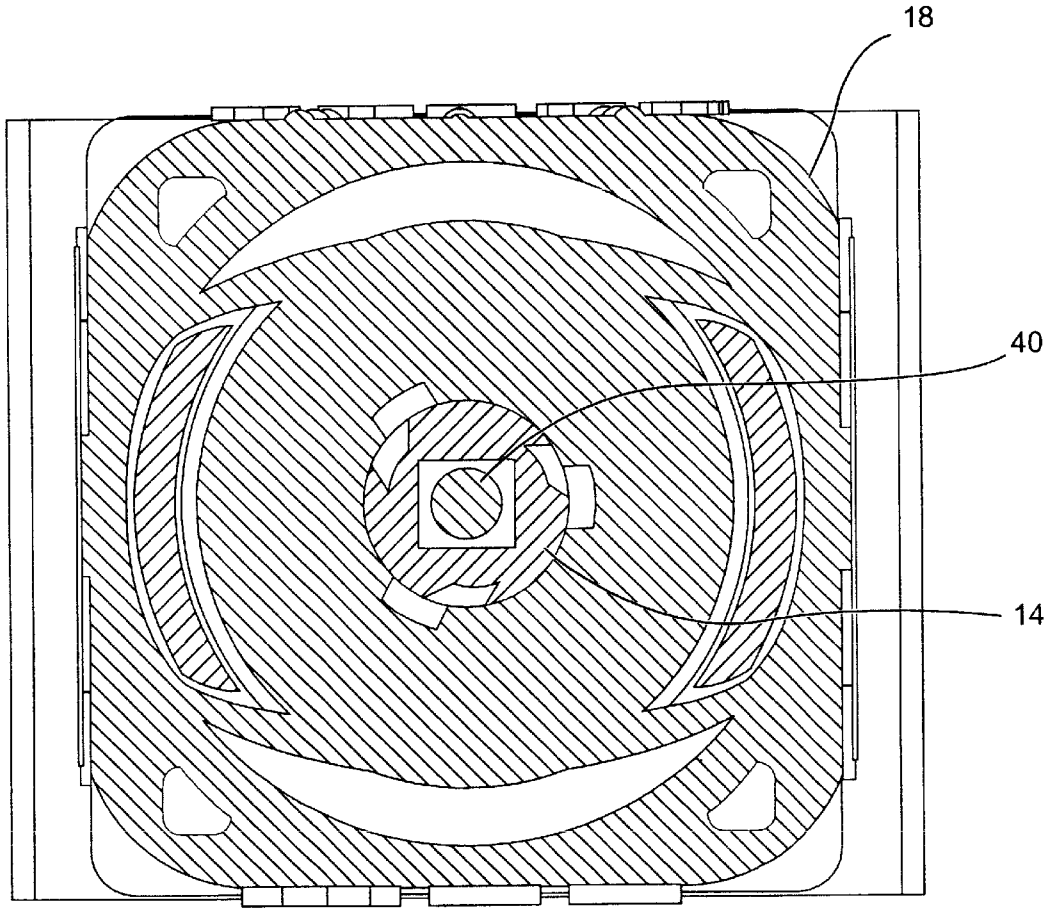
FIG. 7 is a cross-sectional view taken along the line 7—7 of FIG. 6.
Figure 8A:
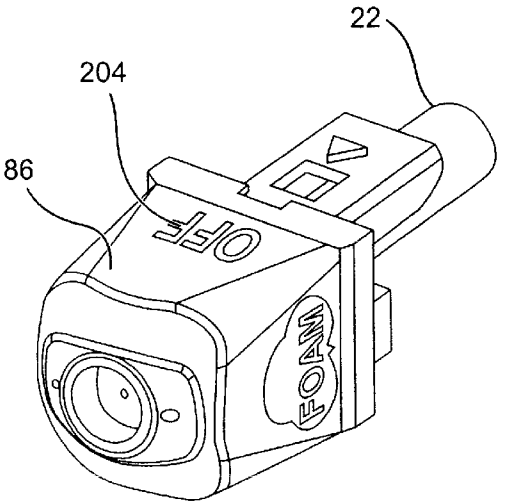
FIGS. 8A through 8D are fragmentary perspective views showing the components in the off-position, foam-position, spray-position and foam-position, respectively, as the cap is rotated successively in the clockwise direction starting from the off-position.
Figure 8B:
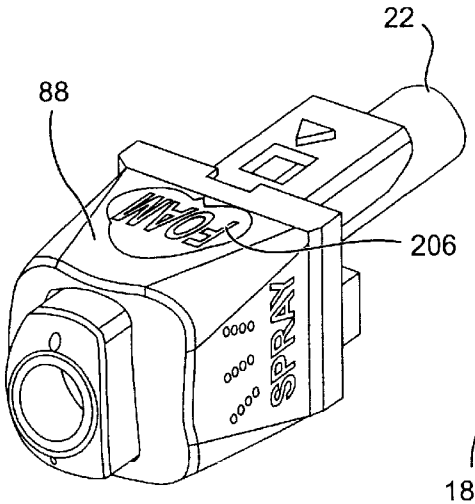
Figure 8C:
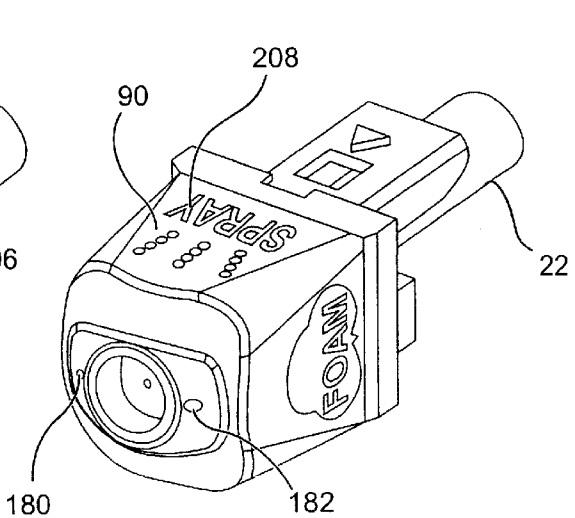
Figure 8D:
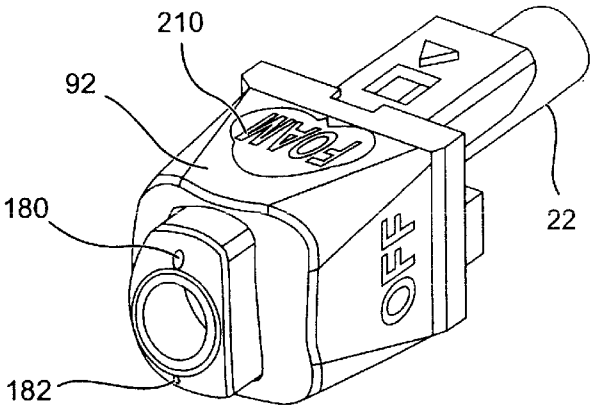

Continued rotation of the cap member 18, in the order of ninety (90) degrees, in the direction shown by the arrow 114 in FIG. 1 from the "foam-position" shown in FIGS. 4 and 5 to the "spray position" shown in FIGS. 6 and 7 again rotates the foamer tube 16 and the cam groove 64 drives the foamer tube 16 to retracted position shown in FIG. 6.

Further rotation of the cap 18, in the order of ninety (90) degrees; in the direction shown by the arrow 212 in FIG. 1 from the "spray-position" shown in FIGS. 6 and 7 again rotates the foamer tube to the extended position shown in FIG. 4.

Still further rotation of the cap 18 in the order of an additional ninety (90) degrees brings the cap 18 again to the "off-position" which is shown in FIGS. 2 and 3.

FIG. 10 shows the various components in the foam position and the direction of flow of the spray material is illustrated by the arrows 147, 148. The spray material flows from the feed tube 22 via the port 28 into the cavity 32 and the channels 33. The spray material in the liquid state enters the spinner face 150 through at least two of the three apertures 152, 154, 156 which are formed in the spinner body.

The liquid enters the spinner face 150 in a direction which is generally tangential to the outer surface 162 of the spinner member 14 resulting in a spin action on the spray material. This spin action in combination with the velocity of liquid and the compressed area of the liquid action results in atomization of the liquid.

During operation in the "foam position," the foamer tube 16 projects beyond the cap member and the flow of spray material through the foamer tube 16 creates a venturi action which causes air to be drawn into the foamer tube 16 through the air openings 180, 182. This flow of air mixes with the liquid which has been atomized by the spinner member 12 resulting in the creation of foam.

The outside air flows through the optional air openings 180, 182 or around the clearance of the foam tube in the direction shown by the arrow 218 in FIG. 9. This direction is opposite to tile flow of spray material which flows through the telescoping foamer nozzle 10 as shown by the arrows 214, 216 in FIGS. 10, 11. The opposing flow directions of the air and the spray material as the air and the liquid start the mixing process combined with the action of the spinner 14 in atomizing the flow of liquid results in the effective production of foam product.

Rotation of the cap member 18 to the spray position halts the production of foam and allows the discharge of the liquid spray materials.

The telescoping foamer nozzle 10 thus provides a means for rapidly and efficiently switching from discharging a liquid spray product to a foam product in a reversible manner.

The foregoing specific embodiment of the present invention as set forth in the specification herein is for illustrative purposes only. Various deviations and. modifications may be made within the spirit and scope of this invention without departing from the main theme thereof.

What is claimed is:

1. A spray and foam producing trigger sprayer comprising:

a sprayer housing;

a cap mounted on the sprayer housing for rotation of the cap in opposite directions about an axis of rotation, the cap being rotatable in the opposite directions for more than one complete rotation of the cap on the sprayer housing, the cap having a nozzle exit port;

a foamer tube mounted on the sprayer housing for axially, linearly reciprocating movement of the foamer tube between a first, retracted position of the foamer tube and a second, extended position of the foamer tube relative to the cap and the sprayer housing; and, the cap and the foamer tube being operatively connected for causing the foamer tube to reciprocate between the first and second positions in response to rotation of the cap on the sprayer housing.

2. The trigger sprayer of claim 1, further comprising:

the operative connection between the cap and foamer tube for causing the foamer tube to reciprocate between the first and second positions is responsive to a quarter rotation of the cap on the sprayer housing.

3. The trigger sprayer of claim 1, further comprising:

the operative connection between the cap and foamer tube for causing the foamer tube to reciprocate between the first and second positions includes a cam surface on the sprayer housing and a cam follower on the foamer tube in sliding engagement with the cam surface.

4. The trigger sprayer of claim 3, further comprising:

the cam surface being one of a pair of opposed cam surfaces that define a cam groove; and, the foamer tube cam follower extends into the cam groove.

5. The trigger sprayer of claim 4, further comprising:

the foamer tube being mounted on the cap for reciprocating movement between the first and second positions with the foamer tube surrounding the nozzle exit port of the cap.

6. The trigger sprayer of claim 1, further comprising:

the foamer tube being mounted on the cap for axial movement of the foamer tube from the first, retracted position to the second, extended position in response to a quarter rotation of the cap, and for axial movement of the foamer tube from the second, extended position to a third, retracted position in response to a further quarter rotation of the cap, and for axial movement of the foamer tube from the third, retracted position to a fourth, extended position in response to a further quarter rotation of the cap, and for axial movement from the fourth, extended position back to the first, retracted position in response to a further quarter rotation of the cap.

7. The trigger sprayer of claim 1, further comprising:

a liquid passage extending through the sprayer housing to the cap nozzle exit port; and a valve with a conical flange positioned in the liquid passage, the conical flange being radially flexible allowing the conical flange to flex radially inwardly when subjected to liquid under pressure in the liquid passage to allow the liquid to pass the conical flange and flow through the liquid passage toward the cap nozzle exit port and to flex radially outwardly to prevent a reverse flow of liquid through the liquid passage from the cap nozzle exit port.

8. The trigger sprayer of claim 7, further comprising:

the liquid passage having an interior wall that surrounds the liquid passage; and, the conical flange having a circular peripheral edge that engages with the liquid passage interior wall.

9. The trigger sprayer of claim 7, further comprising:

a shaft extending through a portion of the liquid passage; and, the conical flange being on the shaft and projecting radially outwardly from the shaft.

10. The trigger sprayer of claim 9, further comprising:

a liquid spinner cavity being formed in one end of the shaft and the conical flange being at an opposite end of the shaft.

11. The trigger sprayer of claim 1, further comprising:

a cam surface on the sprayer housing;

the cap having a pair of openings on opposite sides of the nozzle exit port; and the foamer tube having a pair of guide legs that extend through the cap openings to positions on opposite sides of the cam surface and each guide leg having a follower that engages in sliding contact with the cam surface.

12. A spray and foam producing trigger sprayer comprising:

a sprayer housing;

a liquid feed tube in the sprayer housing;

a trigger mounted on the sprayer housing;

a liquid spinner with a center axis in the sprayer housing, the spinner communicating with the liquid feed tube;

a cap mounted on the sprayer housing for rotation of the cap relative to the sprayer housing, the cap having a nozzle exit port; and a foamer tube mounted on the cap for rotation of the foamer tube with the cap, and for axial movement of the foamer tube between a first, retracted position and a second, extended position of the foamer tube relative to the cap in response to rotation of the cap.

13. The trigger sprayer of claim 12, further comprising:

the cap being mounted on the sprayer housing for continuous rotation of the cap in opposite directions for at least one complete revolution of the cap on the sprayer housing; and, the foamer tube being mounted on the cap for axial movement of the foamer tube from the first, retracted position to the second, extended position, to a third, retracted position and to a fourth, extended position of the foamer tube relative to the cap in response to the cap being rotated in the one direction for at least one complete revolution of the cap on the sprayer housing.

14. The trigger sprayer of claim 12, further comprising:

the cap being rotatable about the liquid spinner center axis and the foamer tube being coaxial with the liquid spinner center axis.

15. The trigger sprayer of claim 12, further comprising:

the feed tube being part of a liquid passage that conducts liquid through the feed tube, past the liquid spinner and through the nozzle exit port of the cap; and a tapered, conical flange in the liquid passage, the conical flange being radially flexible to allow liquid in the liquid passage to pass the conical flange and flow through the liquid passage toward the nozzle exit port of the cap, and to prevent liquid in the liquid passage from passing the conical flange and flow through the liquid passage away from the nozzle exit port of the cap.

16. The trigger sprayer of claim 15, further comprising:

the conical flange being connected to the liquid spinner.

17. The trigger sprayer of claim 15, further comprising:

the conical flange being positioned in a cavity that is a portion of the liquid passage, the cavity having interior walls, and the conical flange engaging against the cavity interior walls.

18. The trigger sprayer of claim 15, further comprising:

a shaft extending through a portion of the liquid passage; and, the conical flange being on the shaft and projecting radially outwardly from the shaft.

19. The trigger sprayer of claim 18, further comprising:

the shaft being a part of the liquid spinner with the conical flange at one end of the shaft and a spinner cavity at an opposite end of the shaft.

20. The trigger sprayer of claim 12, further comprising:

a cam surface on the sprayer housing; and a cam follower on the foamer tube and in engagement with the cam surface whereby rotation of the cap causes the cam follower to move across the cam surface.

21. The trigger sprayer of claim 20, further comprising:

the cam surface being one of a pair of opposed cam surfaces that define a cam groove on the sprayer housing and the cam follower being a boss on the foamer tube that extends into the cam groove and slides through the cam groove in response to rotation of the cap on the sprayer housing.

22. The trigger sprayer of claim 12, further comprising:

a cam surface on the sprayer housing; and, the foamer tube having a pair of guide legs that extend through the cap to positions on opposite sides of the cam surface and each guide leg having a cam follower that engages in sliding engagement with the cam surface.

23. The trigger sprayer of claim 22, further comprising:

the cam surface being one of a pair of opposed cam surfaces that define a cam groove and the cam follower of each guide leg extending into the groove.

* * * * *